United States Patent [19]

Hsieh

[11] Patent Number: 4,910,885

[45] Date of Patent: Mar. 27, 1990

[54] SHOE WITH RESILIENT AND CONVERTIBLE HEEL

[76] Inventor: Jerry W. Hsieh, 23046 Avenida de la Carlota, Ste. 650, Laguna Hills, Calif. 92653

[21] Appl. No.: 144,960

[22] Filed: Jan. 19, 1988

[51] Int. Cl.[4] ..... A43B 21/30

[52] U.S. Cl. ..... 36/37; 36/38; 36/35 R

[58] Field of Search ..... 36/27, 35 R, 35 B, 34 R, 36/37, 38, 7.8

[56] References Cited

U.S. PATENT DOCUMENTS

| | | | |
|---|---|---|---|
| 933,422 | 9/1909 | Dee | 36/38 |
| 1,625,048 | 4/1927 | Nock | 36/38 |
| 2,508,318 | 5/1950 | Wallach | 36/38 |
| 2,555,654 | 6/1951 | Ostrom | 36/38 |
| 3,044,191 | 7/1962 | Cayo | 36/38 |
| 3,886,674 | 6/1975 | Pavia | 36/38 |
| 4,566,206 | 1/1986 | Weber | 36/27 |
| 4,592,153 | 6/1986 | Jacinto | 36/38 |
| 4,610,100 | 9/1988 | Rhodes | 36/42 |
| 4,670,996 | 6/1987 | Dill | 36/36 R |

FOREIGN PATENT DOCUMENTS

| | | | |
|---|---|---|---|
| 2431420 | 1/1975 | Fed. Rep. of Germany | 36/38 |
| 926391 | 9/1947 | France | 36/38 |
| 591740 | 8/1947 | United Kingdom | 36/38 |
| 2111823 | 7/1983 | United Kingdom | 36/38 |

*Primary Examiner*—Steven N. Meyers

*Attorney, Agent, or Firm*—Plante, Strauss, Vanderburgh

[57] ABSTRACT

There is disclosed a resilient heel support for a ladies' shoe which, most preferably, is convertible to heel supports of varied heights, thereby permitting the altering of the height of the heels, at the wearer's whim. The shoe is formed with a conventional upper having a toe and heel portion and a continuous flexible sole. The sole is bifurcated and has an upper arm that extends rearwardly from the instep, following the shoe arch and the contour of the inner sole of the shoe. The lower arm of the bifurcated sole is coplanar with its forward portion terminates in an upwardly directed vertical recess. A convertible heel support is attached to the undersurface of the first arm of the sole at the heel area and this heel support extends into a sliding reception within the vertical recess. The support is pivotally attached to the undersurface of the heel of the first member to permit changing the height of the heel supports. The heel is resiliently cushioned by one of two embodiments which include a leaf spring formed of metal or plastic composite material which is coextensive with the bifurcated portion of the sole. In an alternative embodiment, the heel support is surrounded by a compressible resilient member.

10 Claims, 3 Drawing Sheets

FIG. 8
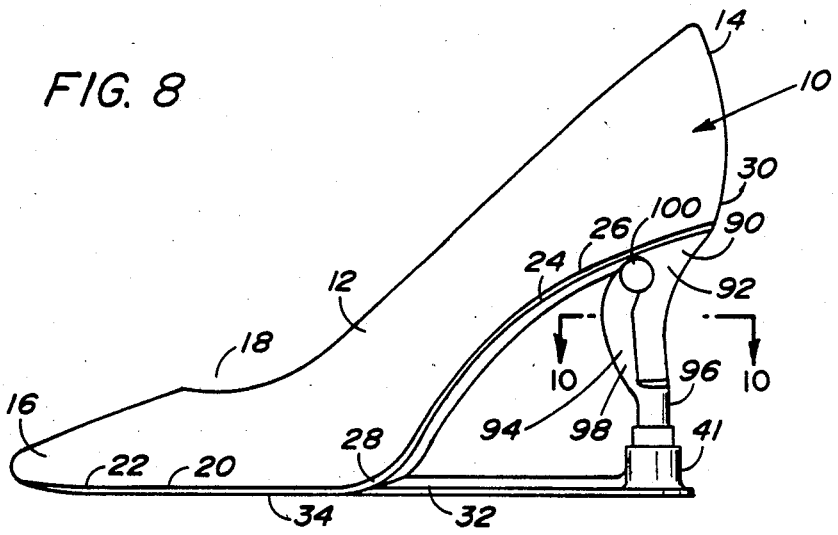
FIG. 9
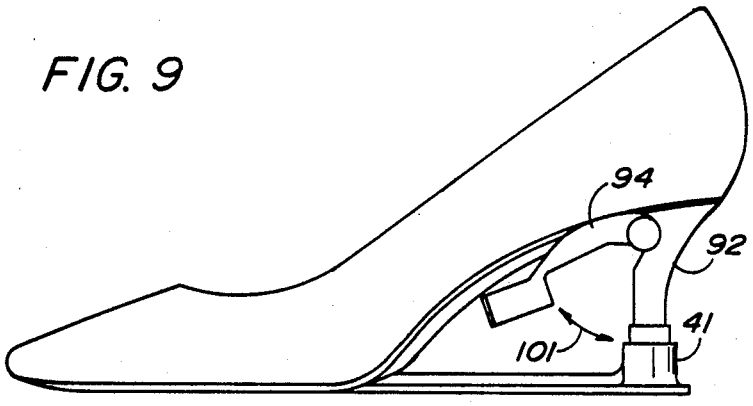
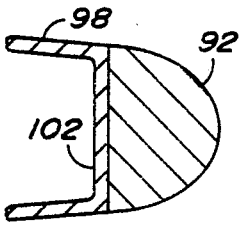
FIG. 10
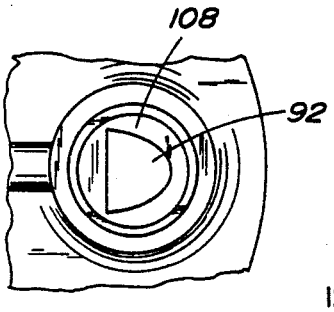
FIG. 12
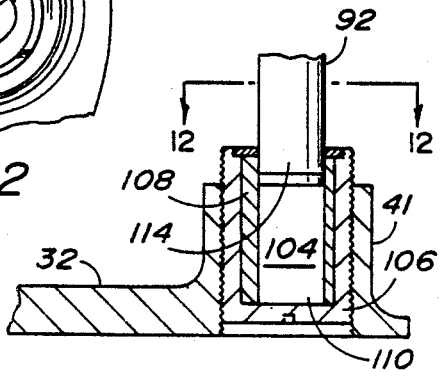
FIG. 11

SHOE WITH RESILIENT AND CONVERTIBLE HEEL

BACKGROUND OF THE INVENTION

1. Field of the Invention

This invention relates to a ladies' shoe and in particular to a shoe having a resilient and convertible heel for wearer comfort.

2. Brief Statement of the Prior Art

Men'shoes and sports shoes have been provided with heel cushions in various forms, including leaf springs as shown in U.S. Pat. No. 4,566,206, compression springs as shown in U.S. Pat. No. 4,296,557, and Bellville conical springs as shown in U.S. Pat. No. 4,342,158. Similar resilient springs have not been applied to high-heeled ladies' shoes, presumably because such structure would detract from the fashionable appearance of the shoes and find only limited acceptance.

High-heeled shoes lack in comfort, particularly for lengthy or strenuous walking and women often carry a second pair of low-heeled shoes to wear when appearances can be sacrificed for comfort. This requires, however, a second pair of shoes which are not always available.

BRIEF STATEMENT OF THE INVENTION

This invention comprises a resilient heel support for a ladies' shoe which, most preferably, is convertible to heel supports of varied heights, thereby permitting the altering of the height of the heels, at the wearer's whim. The shoe is formed with a conventional upper having a toe and heel portion and a continuous flexible sole. The sole is bifurcated and has an upper arm that extends rearwardly from the instep, following the shoe arch and the contour of the inner sole of the shoe. The second arm of the bifurcated sole is coplanar with its forward portion, and extends rearwardly, terminating in an upwardly directed vertical recess. A convertible heel support is attached to the undersurface of the first arm of the sole at the heel area and this heel support extends downwardly toward the second arm of the bifurcated sole, terminating in a sliding reception within the vertical recess that is distally carried on the second arm. The heel support is convertible and pivotally attached to the undersurface of the heel of the first member to permit changing the height of the heel supports. The heel is resiliently cushioned by one of two embodiments which include a leaf spring formed of metal or plastic composite material which is coextensive with the bifurcated portion of the sole. In an alternative embodiment, the heel support is surrounded by a compressible resilient member.

BRIEF DESCRIPTION OF THE DRAWINGS

The invention will be described with reference to the drawings of which:

FIG. 8 is a view of a convertible shoe;

FIG. 9 is a view of the convertible shoe with its lower heel support;

FIG. 10 is a view along line 10—10' of FIG. 9;

FIG. 11 is a sectional view of the lower end of the heel support; and

FIG. 12 is a view along line 12—12' of FIG. 11.

DESCRIPTION OF PREFERRED EMBODIMENT

Figure 1:
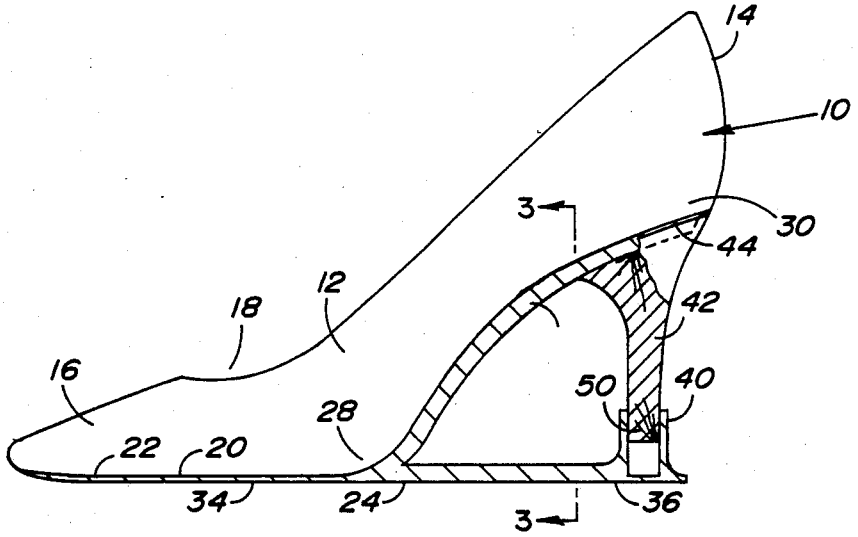
FIG. 1 is an elevational view partly in cross section, of the leaf spring embodiment of the invention.

Referring now to FIGURE the shoe 10 of the invention has a generally conventional shape of a ladies' high-heeled pump with an upper 12 having a heel portion 14 and a toe portion 16 with an open top 18. The shoe 10 has a continuous outer sole 20 extending from the toe portion 16 to the heel portion 14 with a conventional inner sole 22. The outer sole 20 is secured to a resilient leaf spring member in the form of a bifurcated spring 24 having a first arm 26 that is coextensive the outer sole 20 from the instep region 28 to the heel 30 and a second, lower arm 32 that is coplanar with the forward portion 34 of the sole 20 and that extends rearwardly, terminating beneath the heel 30 of the shoe. At its rear end 36, this lower arm 32 of the bifurcated spring 24 has an upwardly facing recess 38. This recess 38 is preferably formed by a vertical boss 40 distally carried by the lower arm 32.

A heel support 42 having a more or less conventional spike heel configuration is attached to the undersurface 44 of the outer sole 20 beneath the heel 30 of the shoe 10. The lower end 50 of the heel support 42 is received within the upwardly facing recess 38 and is generally coaxial therewith to permit free sliding movement of the lower end 50 of the heel support 38 within the recess. The degree of sliding movement of the heel is controlled by the height of the heel support which is selected.

Figure 3:
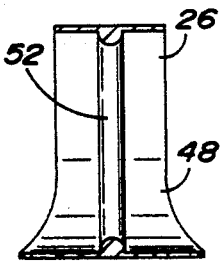
FIG. 3 is a view along lines 3—3 of FIGURE 1.

The bifurcated resilient spring 24 can be formed of suitable resilient material, e.g., spring steel, or composite plastic materials such as fiber-reinforced plastics, e.g., fiberglass, graphite, or carbon reinforced plastics. The rigidity and strength of the resilient spring 224 can be enhanced by the use of longitudinal and coextensive reinforcement ribs 52 and 54 along each of the arms of the bifurcated spring 24. These ribs are shown in FIG. 3 for the rib 52 on the undersurface 44 of the first, upper arm 26, and in FIG. 4 as rib 54 for the reinforcement of the second, lower arm 32 of the bifurcated spring 24.

Figure 2:
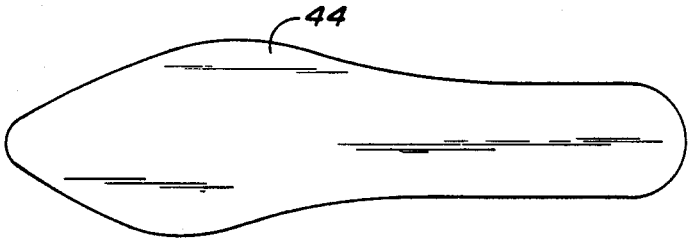
FIG. 2 is a view along lines 2—2 of FIGURE 1.
Figure 4:
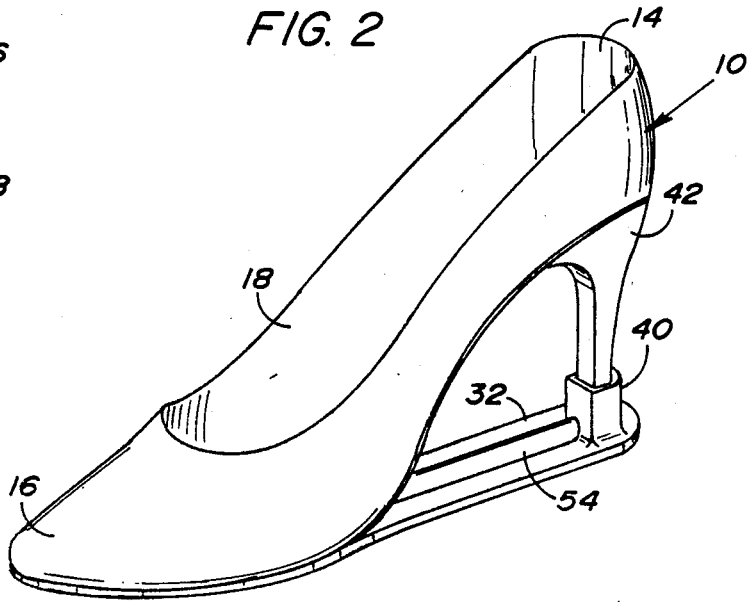
FIG. 4 is a perspective view of the shoe of FIG. 1.

The undersurface 44 of the outer sole 22 and upper arm 26 is shown in FIG. 2 and a perspective view of the shoe is illustrated in FIG. 4.

Figure 5:
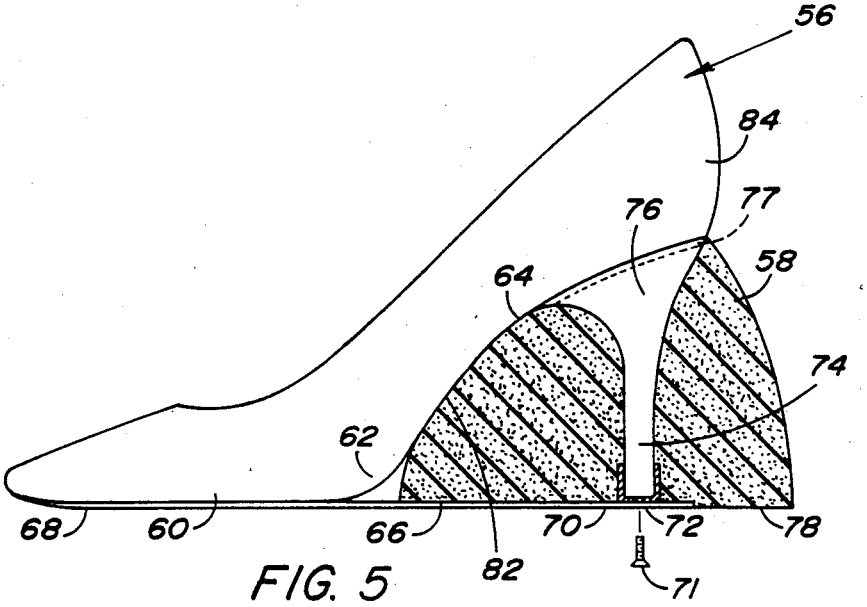
FIG. 5 is an elevational view partly in cross section, of the second embodiment of the shoe of the invention.
Figure 6:
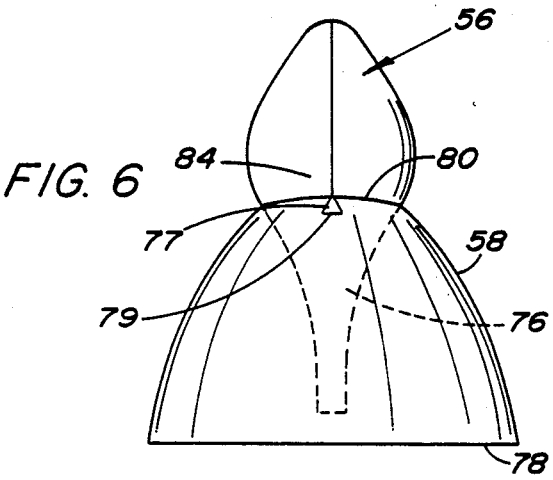
FIG. 6 is a rear vie of the shoe of FIG. 5.
Figure 7:
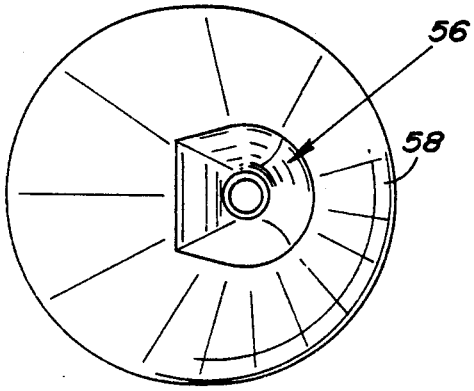
FIG. 7 is a view of the top surface of the heel cushion and heel support.

Referring now to FIG. 5, the invention is illustrated as applied to an alternative shoe 56 in which the resilient and shock absorbing function is provided by a compressible member 58. Preferably the compressible member 58 is formed of an open celled, cellular plastic foam which is flexible and compressive, e.g., polyurethane foam, ethylene-vinyl acetate foam, high resiliency polyurethane foam, polyethylene foam, etc. As with the previous embodiment, this embodiment also has an outer sole 60 which is bifurcated at the instep 62 and extends rearwardly with a first, upper arm 64 and a second, lower arm 66. The lower arm 66 is, as with the previous embodiment, coplanar with the forward portion 68 of the outer sole 60 and supports at its rear end 70, an upwardly facing recess 72 which slidably receives the lower end 74 of the removable heel support 76.

The resilient compressible member 58 entirely surrounds the heel support 76. The preferred and illustrated shape or configuration of the resilient compressible member 58 is generally frustro-conical with a flat, wide base 78 that tapers to a reduced width upper surface 80 that preferably has a contour which mates with and receives the undersurface 82 of the instep portion 62 and the heel 84 of the sole. If desired, a supplemental cushion 86 can also be placed in the recess 72, beneath the lower end of the heel 84 to provide additional resiliency in the assembly.

Preferably, the heel support 76 and resilient compressible member 58 are removable and interchangeable with heel supports and compressible members of varied shapes and heights. For this purpose, the upwardly facing recess 72 is removably attached to the lower arm 66 with a machine screw 71, and the upper end of the heel support 76 is removably attached to the undersurface of the sole with a key 77 on the sole which fits into a keyway 79 in the upper end of the heel support 76. In this fashion, the heel support 76 can be removed and the shoe can be converted from a high heel shoe to a lower profile with a lower heel support for comfort during walking. If desired, the entire heel support can be removed and the resilient compressible member 38 used only as the heel support thereby providing a greater degree of flexing and cushioning than is possible with the assembly as illustrated in FIG. 5.

Referring now to FIG. 8, there is illustrated a ladies' pump with a convertible heel support. The shoe 10 is illustrated with a conventional upper 12 having a heel 14 and a toe 16 with an open top 18. This shoe, as previously described, has an inner sole 22 and an outer sole 20. The outer sole 20 has a resilient spring member in the form of a bifurcated spring 24 having a first arm 26 that is coextensive the outer sole 20 from the instep region 28 to the heel 30 and a second lower arm 32 that is coplanar with the forward portion 34 of sole 20.

The heel support 90 comprises a first, low heel 92 and a pivotally interconnected high heel 94 which has a leg 96 that is vertically disposed beneath the lower end of heel 92 in the configuration shown in FIG. 8. The leg 96 is supported by arms 98 which extend forward of the heel 92 to the arm 26 where they are interconnected to the shoe in a pivotal engagement by pin 100. The lower end of the heel portion 96 is received within the upwardly facing recess 41, previously described.

Referring now to FIG. 9, the shoe is illustrated in its converted low-heel form. As there illustrated, the high heel support 94 has been removed from the upwardly facing recess 41 and has been swung forwardly as indicated by the double arrowhead line 101, clearing the heel support member 94 from the heel structure. The shoe is then free to assume a lower configuration in which the lower heel member 92 is inserted into the upwardly facing recess 41.

As shown in FIG. 10, the lower heel 92 is generally solid form while the support arms 98 of the lower heel member 94 have a channel shape with a wide base flange 102 that extends between the opposite side arms 98

Referring now to FIG. 11, the recess 41 will be described in greater detail. As there illustrated, upwardly facing recess 41 is distally supported on the lower or second arm 32 of the bifurcated spring 24. The lower heel 92 is received within the central well 104 of the upwardly facing recess 41. Preferably, the recess includes a threadably inserted sleeve 106 having external cylindrical threads which engage mating threads on the inside wall of recess 41. As the heel 92 is not circular (see FIG. 12), a cylindrical sleeve 108 is received within the threadably engaged sleeve 106. This sleeve 108 has a central chamber 110 having a cross section hat mates with the cross section of heel 92, and an outer cylindrical wall, all as illustrated in FIG. 12. This permits the rotatable sleeve 106 to be elevated or lowered in the cylindrical recess 41 as necessary so the lower end 114 of the heel 92 remains captured within this recess.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A resilient, shock absorbing shoe which comprises:

a. a shoe upper having an upper portion with a toe and heel;

b. a bifurcated sole having upper and lower arms forming a leaf spring member extending rearwardly from the toe with said lower arm extending rearwardly beneath the heel area of said shoe and distally supporting an upwardly directed vertical recess;

c. a vertical heel support located beneath the heel of said sole and extending downwardly and between the upper and lower arms of said bifurcated sole leaf spring member with its lower end slidably received within said vertical recess; and d. a compressible support member surrounding said vertical heel support.

2. The shoe of claim 1, including a reinforcing rib coextensive with the length of said upper arm.

3. The shoe of claim 2 including a reinforcing rib coextensive the length of said lower arm.

4. A resilient, shock absorbing shoe which comprises:

a. a shoe upper having an upper portion with a toe and heel;

b. a sole extending rearwardly from the toe and having an upper arm and a lower arm;

c. a vertical heel support located beneath the heel of said sole and extending downwardly and between the upper and lower arms of said leaf spring member; and d. a compressible support member which is conically shaped with a wide base and an upper surface contoured to fit the undersurface of the heel area of said sole surrounding said vertical heel support.

5. A resilient, shock absorbing shoe which comprises:

e. a shoe upper having an upper portion with a toe and heel;

f. a bifurcated sole having upper and lower arms forming a leaf spring member extending rearwardly from the toe with said lower arm extending rearwardly beneath the heel area of said shoe and distally supporting an upwardly directed vertical recess;

g. a vertical heel support attached to the undersurface of said sole to permit interchanging of said support with at least one additional heel support of varied height, said heel support located beneath the heel of said sole and extending downwardly and between the upper and lower arms of said bifurcated sole leaf spring member with its lower end slidably received within said vertical recess.

6. The shoe of claim 5 wherein said heel support is pivotally attached to the undersurface of said upper arm to permit interchanging of said heel support with heel supports of varied heights.

7. The shoe of claim 5 wherein said heel support comprises a first, high heel which is pivotally attached to said heel support for pivotal movement between a vertical position and a forward, inclined position, and which has a lowermost end that is received in said vertical recess when said first heel is in its vertical position, and having a stepped offset intermediate its length to provide a horizontal shelf, and a second, low heel which rests on said horizontal shelf when said first heel is in its vertical position, and which is slidably received in said vertical recess when said first heel is in its inclined position.

8. The shoe of claim 7 wherein said vertical recess includes means to extend its height and permit slidable reception of said second low heel.

9. The shoe of claim 5 wherein said heel support is removably attached to said sole of said shoe and is interchangeable with other heel supports.

10. The shoe of claim 9 including a compressible heel support surrounding said vertical heel support and also removably attached to the undersurface of said sole.

* * * * *